US006778804B2

(12) United States Patent
Yoshinaga et al.

(10) Patent No.: US 6,778,804 B2
(45) Date of Patent: Aug. 17, 2004

(54) FIXING DEVICE AND IMAGE FORMING APPARATUS INCLUDING THE SAME

(75) Inventors: Hiroshi Yoshinaga, Ichikawa (JP); Motokazu Yasui, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/409,121

(22) Filed: Apr. 9, 2003

(65) Prior Publication Data

US 2003/0215271 A1 Nov. 20, 2003

(30) Foreign Application Priority Data

Apr. 12, 2002 (JP) ..... 2002-110809

(51) Int. Cl.[7] ..... G03G 15/20
(52) U.S. Cl. ..... 399/325; 399/328; 399/329
(58) Field of Search ..... 399/325, 328, 399/329; 219/216

(56) References Cited

U.S. PATENT DOCUMENTS 4,593,992 A * 6/1986 Yoshinaga et al. ..... 399/321
5,666,623 A * 9/1997 Yamada et al. ..... 399/320
6,580,893 B2 * 6/2003 Ishizuka ..... 399/325

* cited by examiner

*Primary Examiner*—Hoan Tran
(74) *Attorney, Agent, or Firm*—Oblon, Spivak, McClelland, Maier & Neustadt, P.C.

(57) ABSTRACT

A fixing device for an image forming apparatus includes a heating member, a pressing member facing the heating member, a coating member for coating a parting agent on the heating member, and agent feeding means intermittently brought into contact with the coating member. Assume that a distance between a nip between the agent feeding means and the coating member, as measured in the direction of forward rotation of the coating member, is A, that a distance between a nip between the coating member and the heating member and a nip between the heating member and the pressing member, as measured in the direction of forward rotation of the heating member, is B, and that the circumferential length of the heating member is C. Then, a period of time T in which the recording medium enters the nip between the heating member and the pressing member satisfies a relation:

$$A+B+C/\text{linear velocity of image formation} \leqq T.$$

8 Claims, 4 Drawing Sheets

FIXING DEVICE AND IMAGE FORMING APPARATUS INCLUDING THE SAME

BACKGROUND OF THE INVENTION

1. Field of the Invention

The present invention relates to a fixing device for fixing a toner image carried on a recording medium and an image forming apparatus including the same.

2. Description of the Background Art

A copier, facsimile apparatus, printer or similar image forming apparatus usually includes a fixing device for fixing a toner image carried on a paper sheet or similar recording medium. One of conventional fixing devices. includes a heat roller and a press roller facing each other. While the recording medium is conveyed via a nip between the heat roller and the press roller, the press roller fixes the toner image on the recording medium with heat.

Another conventional fixing device includes a fixing belt passed over a pair of rollers and substituted for the heat roller mentioned above. One of the pair of rollers faces the press roller also mentioned above. The roller, which drives the belt in cooperation with the other roller facing the press roller, accommodates a heat source for heating the inner surface of the belt. The press roller also accommodates a heat source for heating the outer surface of the belt. Generally, a belt is smaller in volume and thermal capacity than a roller and can therefore be heated more rapidly than a roller. In this sense, this type of fixing device implements a shorter warm-up time that the previous fixing device at the beginning of operation. In addition, the heat roller disposed in the press roller heats the belt for thereby further reducing the warm-up time.

When the rollers of the fixing device are formed of aluminum having high thermal conductivity, the belt may be provided with a two-layer structure made up of a base formed of stainless steel and a parting layer formed on the base and formed of silicone rubber or fluorocarbon resin, as known in the art.

The belt type of fixing device additionally includes a coating device for coating oil, or parting agent, on the belt. The coating device includes a coating roller or similar coating member held in contact with the belt for applying oil to the belt and oil feeding means implemented as a piece of felt impregnated with oil. The oil feeding means is held in contact with the coating roller over a period of time controlled in accordance with the duration of operation or that of non-operation of the oil feeding means, thereby feeding an adequate amount of oil to the belt. The coating roller is made up of a metallic core and sponge-like rubber covering the core.

Generally, an image forming apparatus is capable of dealing with not only plain paper sheets customary with, e.g., a copier, but also OHP (OverHead Projector) sheets, cards, postcards and other thick sheets of 90K or above and having a weight of 100 g/m$^2$, and envelopes and other special sheets having greater thermal capacity that sheets. However, the problem with the belt type of fixing device is that oil coated on the belt is irregularly distributed on the belt in accordance with the cell diameter of the sponge-like rubber of the coating member. Particularly. when the recording medium is an OHP sheet, even fine irregularity of oil distribution on the belt directly translates into irregular transmittance. As a result, in a color image, a solid, yellow portion suffers from haze.

SUMMARY OF THE INVENTION

It is an object of the present invention to provide a fixing device capable of obviating fine irregularity of coating ascribable to the cell diameter of the sponge-like rubber of a coating member for thereby freeing an OHP sheet from short transmittance and haze, and an image forming apparatus including the same.

A fixing device for fixing a toner image carried on a recording medium of the present invention includes a heating member, a pressing member facing the heating member, a coating member for coating a parting agent on the heating member, and an agent feeding device intermittently brought into contact with the coating member for feeding the parting agent. Assume that a distance between a nip between the agent feeding means and the coating member, as measured in the direction of forward rotation of the coating member, is A, that a distance between a nip between the coating member and the heating member and a nip between the heating member and the pressing member, as measured in the direction of forward rotation of the heating member, is B, and that the circumferential length of the heating member is C. Then, a period of time T in which the recording medium enters the nip between the heating member and the pressing member satisfies a relation:

$$A+B+C/\text{linear velocity of image formation} \leqq T$$

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
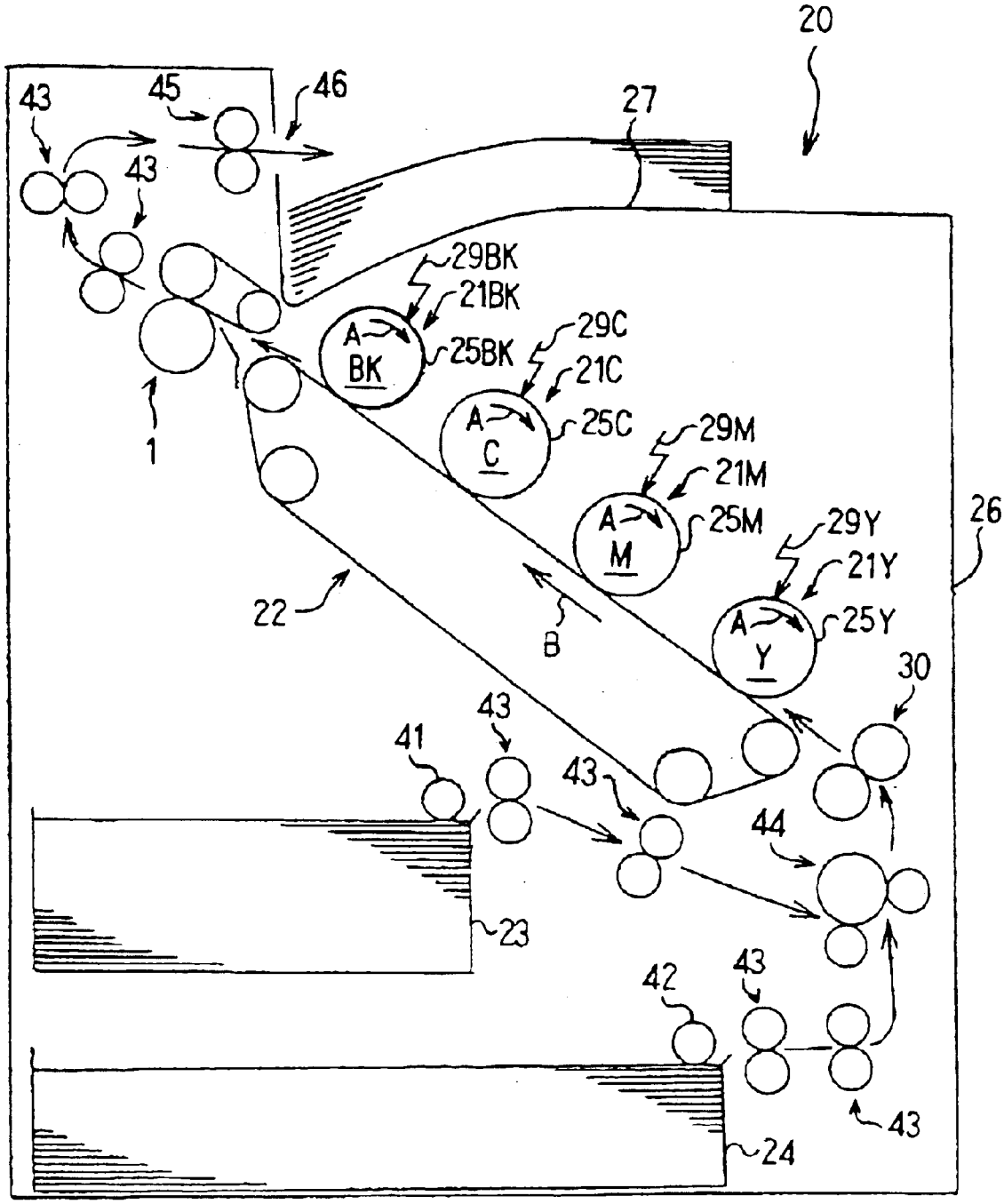
FIG. 1 is a view showing an image forming apparatus embodying the present invention.

Referring to FIG. 1 of the drawings, an image forming apparatus embodying the present invention is shown and implemented as a copier or a printer capable of forming a full-color image by way of example. As shown, the image forming apparatus, generally 20, includes four image forming devices 21Y, 21M, 21C and 21BK for forming a yellow (Y), a magenta (M), a cyan (C) and a black (BK) toner image, respectively. An image transferring device 22 is arranged to face the image forming devices 21Y through 21BK.

Sheet cassettes 23 and 24 each are loaded with a stack of sheets or recording media of particular size to be fed to image transfer positions where the image forming devices 21Y through 21BK and image transferring device 22 face each other. A registration roller pair 30 conveys a sheet, which is fed from either one of the sheet cassettes 23 and 24, in synchronism with image formation effected by the image forming devices 21Y through 21BK. A fixing device 1 is configured to fix a toner image transferred to the sheet.

The apparatus 20 is capable of dealing with not only plain paper sheets customary with, e.g., a copier, but also OHP sheets, cards, postcards and other thick sheets of 90K or above and having a weight of 100 g/m$^2$, and envelopes and other special sheets having greater thermal capacity that sheets.

The image forming devices 21Y through 21BK are substantially identical in configuration with each other except for the color of toner stored therein. Let the following description concentrate on the image forming device 21Y by way of example.

The image forming device 21Y includes a photoconductive, drum or image carrier 25Y. A charger, a developing unit, a cleaning unit and other conventional process units are sequentially arranged around the drum in a direction A in which the drum 25Y rotates, although not shown specifically. An optical scanning unit, not shown, including a polygonal mirror scans the surface of the drum 25Y charged by the charger with a light beam 29Y in accordance with image data. The drum 25Y may, of course, be replaced with a photoconductive belt. A light beam 29BK assigned to the image forming device 21BK may be implemented as two light beams. The image forming device 21BK is capable of forming an image at higher speed than the other image forming devices 21Y through 21C.

Sheets S of size A4 and sheets S of size A3 are respectively stacked on the sheet cassettes 23 and 24, and each is elongate in the right-and-left direction, as viewed in FIG. 1. The image transferring device 22 is inclined to reduce the overall size of the apparatus 20 in the right-and-left direction, as viewed in FIG. 1, and conveys the sheet S obliquely in a direction B. In this configuration, the width of the apparatus 20 in the right-and-left direction is only slightly greater than the length of the sheet S of size A3. More specifically, the apparatus 20 is provided with a minimum necessary size that can accommodate the sheets S. The apparatus 20 includes a casing 26 whose top is implemented as a print tray 27 on which the sheets S passed through the fixing device 1 and each carrying a toner image thereon are sequentially stacked.

Pickup rollers 41 and 42 are respectively associated with the sheet cassettes 23 and 24, and each pays out the sheets S from the associated sheet cassettes 23 or 24 one by one. The sheet paid out from the sheet cassette 23 or 24 is conveyed to the registration roller pair 30 by rollers 43 and 44. An outlet roller 45 drives the sheet S out of the casing 26 to the print tray 27 via an opening 46.

Figure 2:
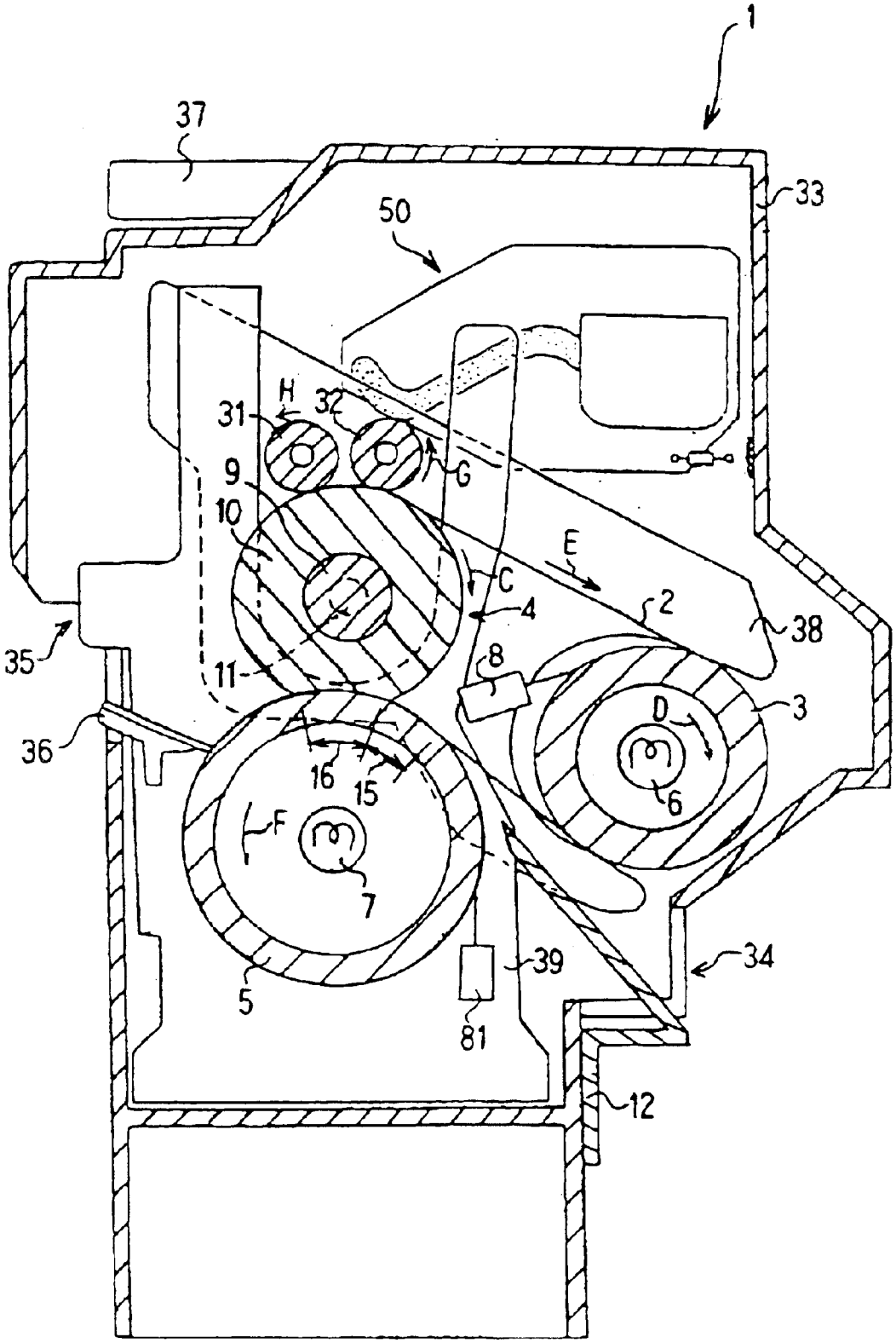
FIG. 2 is a fragmentary view showing a fixing device included in the illustrative embodiment.

As shown in FIG. 2, the fixing device 1 includes an endless fixing belt or sheet conveying member (simply belt hereinafter) 2 for conveying the sheet S, which carries a toner image thereon. The belt 2 is passed over a heat roller 3 and a drive roller 4. A press roller 5 faces the drive roller 4 with the intermediary of the belt 2. Heater or heat sources 6 and 7 are received in the heat roller 3 and press roller 5, respectively. A thermistor or temperature sensing means 8 faces the heat roller 3 for sensing the temperature of the heat roller 3. A cleaning roller 31 faces the drive roller 4 with the intermediary of the belt 2. A coating roller or coating member 32 coats oil, or parting agent, on the belt 2. Agent feeding means 50 feed soil to the coating roller 32. A casing 33 is formed with an inlet guide 12 and an outlet guide 36 and provided with a knob 37. The heat roller 3, drive roller 4 and belt 2 are integrally supported by a support 38. The support 38 and press roller 5 are mounted on the casing 33 via a support 39.

The heat roller 3 and drive roller 4 are constantly biased away from each other by springs or similar biasing means, exerting preselected adequate tension on the belt 2. The drive roller 4 is made up of a metallic core 9 and a heat-resistant elastic layer 10 covering the surface of the core 9. The core 9 has a shaft portion 11 connected to drive means, not shown, so that the drive roller 4 is rotatable in a direction C shown in FIG. 2. The drive roller 4 moves the belt 4 in a direction E with the result that the heat roller 3 rotates in a direction D, following the movement of the belt 4. At the same time, the press roller 5 and coating roller 32 are moved in directions F and G, respectively.

The supports 38 and 39 are constantly biased toward each other by springs or similar biasing means, so that the press roller 5 and drive roller 4 are pressed against each other via the belt 4 by pressure of 10 kgf or above. The press roller 5 is held in contact with the drive roller 4 such that a virtual line connecting the axis of the drive roller 4 and that of the heat roller 3 and a virtual line connecting the axis of the heat roller 3 and that of the press roller 5 form an acute angle therebetween. In this condition, a first and a second fixing region 15 and 16 for fixing toner on the sheet S are formed, as illustrated. In the first fixing region 15, the press roller 5 does not face the drive roller 4, but contacts only the belt 2. In the second fixing region 16, the press roller 5 contacts the drive roller 4 with the intermediary of the belt 2.

The casing 33 is formed with an inlet 34 facing the image transferring device 22 and an outlet 35 positioned at the opposite side to the inlet 34 with respect to the first and second fixing regions 15 and 16. The sheet S is introduced into the casing 33 via the inlet 34 and then driven out of the same via the outlet 35. The inlet guide 12 has a base portion affixed to the outer surface of the casing 33 below the inlet 34 and a guide portion extending from the base portion into the casing 33 toward the first fixing region 15.

The belt 2 is made up of a 100 $\mu$m thick base formed of nickel and a 200 $\mu$m thick parting layer formed of silicone rubber, so that the belt 2 has small thermal capacity and sharp thermal response. The belt 2 has a diameter of 60 mm when configured as a circle. The base of the belt 2 may alternatively be formed of SUS (chrome stainless steel prescribed by Japanese Industrial Standards) or polyimide and may be about 30 $\mu$m to 150 $\mu$m thick in consideration of flexibility. The parting layer should preferably be about 50 $\mu$m to 300 $\mu$m thick when formed of silicone rubber or about 10 $\mu$m to 50 $\mu$m when formed of fluorocarbon resin. Alternatively, the parting layer may be a laminate of silicone rubber and fluorocarbon resin overlying it.

The belt 2 should preferably exhibit a self-cooling function in the fixing region to such a degree that the belt 2 can be instantaneously heated and that hot offset does not occur. On the other hand, the belt 2 must be provided with thermal capacity large enough to sufficiently melt toner in the fixing region. The material and thickness of the belt 2 stated above satisfies both of such conditions. The self-cooling function refers to a phenomenon that the belt 2 is automatically cooled off during fixation because a heat source is absent at the image side of the sheet S in the fixing region.

Tension of 3 kgf acts on each of opposite runs of the belt 2 because the heat roller 3 and drive roller 4 are biased away from each other. The tension is controllable by adjusting the biasing force-of the springs mentioned earlier and should preferably be between 1 kgf (9.8 N) and 3 kgf (29.4 N).

The heat roller 3 and press roller 5 each are implemented as a hollow, cylindrical metallic core whose wall thickness is small enough to reduce thermal capacity. More specifically, the heat roller 3 has a diameter of 20 mm or above, but 30 mm or below, and wall thickness of 0.3 mm or above, but 2.0 mm or below. The press roller 5 has a diameter of 30 mm or above, but 50 mm or below, and wall thickness of 0.3 mm or above, but 1.5 mm or below. The heat roller 3 and press roller 5 with such configurations have thermal capacities of 26 cal/° C. or below and 36 cal/° C. or below, respectively.

In the illustrative embodiment, the core of the heat roller 3 is formed of aluminum and provided with a diameter of 30 mm and wall thickness of 0.7 mm. The material of this core should preferably have low specific heat and high thermal conductivity; aluminum maybe replaced with, e.g., iron, copper stainless steel or similar metal. Further, the wall thickness may be between 0.6 mm and 1.4 mm when the core is formed of aluminum and provided with a diameter of 30 mm or may be between 0.3 mm and 0.9 mm when it is formed of iron and provided with a diameter of 20 mm. Wall thickness is reduced in accordance with an increase in diameter in consideration of the bending of the roller in the axial direction.

In any case, the lower limit of wall thickness is indicative of an allowable value when consideration is given to the deformation of the heat roller 3 ascribable to the tension of the belt 2. Also, the upper limit of wall thickness is indicative of an allowable value necessary for implementing a desired warm-up time. The roller diameter of 20 mm or above is selected to guarantee the tension of the belt 2 for thereby obviating the bending of the roller in the axial direction. The roller diameter of 20 mm to 30 mm is selected to implement, when the sheet S is conveyed at a rate of 200 mm/sec or below, the thermal capacity of about 26 cal/° C. that maintains the belt 2 at constant temperature necessary for fixation even in a repeat print mode.

The heat roller 3 with the above small thermal capacity does not absorb the heat of the belt 2 while the belt 2 is in movement and therefore does not adversely effect fixation or extend the warm-up time. Moreover, even if temperature is lowered due to, e.g., repeated fixation, it can be recovered in a short period of time.

The heater 6 disposed in the heat roller 3 heats the belt 2 via the heat roller 3. The output of the thermistor 8, which is responsive to the temperature of the heater 6, is sent to control means, not shown, as a temperature signal. The control means compares the temperature signal with target fixing temperature and energizes the heater 6 if the former is lower than the latter or deenergizes the heater 6 if the former is-higher than the latter. Such feedback control successfully maintains the surface temperature of the belt 2 at 110° C. or above. It is to be noted that the thermistor 8 is held in contact with the heat roller 3 in a trailing position in the direction D in order to reduce wear.

The elastic layer of the roller 4 is formed of rubber, more specifically silicone sponge rubber, i.e., foam. The cells of foam each have a diameter of 500 $\mu$m, particularly 300 $\mu$m or below in the vicinity of the surface of the roller 4. While foam allows a minimum of temperature drop to occur in the elastic layer 10 during fixation, it is apt to lower fixing pressure and therefore to reduce gloss or make the surface rough. A rough surface would result in an irregular gloss distribution. However, the cell diameter of foam mentioned above obviates short or irregular gloss. If desired, an about 1 mm thick, non-foam skin layer may be formed on the surface of the elastic layer The surface roughness of the elastic layer 10 is selected to be 20 HS or above in ASKER C scale included in SRIJ (The Society of Rubber Industry, Japan) standards) This surface hardness prevents, whether or not a skin layer is present, the rough surface of foam from effecting image quality and obviates irregular gloss, thereby insuring desirable fixation. Because the drive roller 4 has a diameter of 30 mm and because the material of the elastic layer 10 has low thermal conductivity and a heat-resistant cellular structure, the elastic layer 10 absorbs a minimum of heat of the belt 2, reduces temperature drop after warm-up, and reduces a prerotation time for temperature recovery. Moreover, because the elastic layer 10 has relatively low hardness, a sufficient nip width is insured between the roller 4 and the press roller 5 even if pressure acting therebetween is low. It follows that desirable fixation is achievable even with low temperature and low pressure.

As for the press roller 5, the core is formed of iron and provided with a diameter of 40 mm and wall thickness of 1.0 mm. Iron may be replaced with any other metal having high thermal conductivity, e.g., aluminum, copper or stainless steel. Alternatively, wall thickness may be between 0.4 mm and 1.0 mm when the core is formed of iron and has a diameter of 30 mm, between 0.3 mm and 0.8 mm when it is formed of iron and has a diameter of 50 mm, between 1.3 mm and 1.5 mm when it is formed of aluminum and has a diameter of 30 mm or between 0.6 mm and 1.2 mm when it is formed of aluminum and has a diameter of 50 mm. Wall thickness is reduced in accordance with an increase in diameter in consideration of the bending of the roller in the axial direction.

In any case, the lower limit of wall thickness is indicative of an allowable value when consideration is given to the deformation of the press roller 5 ascribable to surface pressure of 0.6 kg/cm$^2$, which is the lower limit of fixing pressure. Also, the upper limit of wall thickness is indicative of an allowable value necessary for implementing a desired warm-up time. The roller diameter of 30 mm or above is selected to guarantee the fixing pressure for thereby obviating the bending of the roller in the axial direction. The roller diameter of 30 mm to 50 mm is selected to implement, when the sheet S is conveyed at a rate of 200 mm/sec or below, the thermal capacity of about 26 cal/° C. that maintains the belt 2 at constant temperature necessary for fixation even in a repeat print mode.

The press roller 5 with the above small thermal capacity absorbs a minimum of heat of the belt 2 while the belt 2 is in movement. Particularly, in the illustrative embodiment, the heater 7 disposed in the press roller 5 obviates the temperature drop of the belt 2, which would adversely effect fixation or would extend the warm-up time. Moreover, even if temperature is lowered due to, e.g., repeated fixation, it can be recovered in a short period of time. The heater 7 not only heats the press roller 5 and reduces the warm-up time, but also feeds heat from the back of the sheet S during fixation for thereby further promoting stable fixation.

A 10 $\mu$m to 300 $\mu$m thick parting layer may be formed on the core of the press roller 5. The heater 7 heats the heat roller 5 while a thermistor 81 senses the temperature of the press roller 5. A temperature signal output from the thermistor 81 is also sent to the controller mentioned earlier. The controller compares the temperature signal with target fixing temperature and energizes the heater 7 if the former is lower than the latter or deenergizes it if the former is higher than the latter. Such feedback control successfully maintains the surface temperature of the press roller 5 at 110° C. or above. It is to be noted that the thermistor 81 is held in contact with the press roller 5 in a trailing position in the direction F in order to reduce wear.

Why the wall thickness of the heat roller 3 and that of the press roller 5 can be reduced to lower thermal capacity is that the fixing device 1 is of type using the belt 2. More specifically, fixation is effected over the relatively long first and second fixing regions 15 and 16, so that fixing pressure and therefore the mechanical strength of the press roller 5 can be reduced. Further, the heat roller 3 can be reduced in wall thickness because it is not pressed against the press roller 5. Fixation effected over such a length additionally lowers fixing temperature for thereby reducing the warm-up time. In addition, the heated belt 2 is cooled off to suitable temperature while being conveyed, reducing offset. In the illustrative embodiment, the output of each heater 6 or 7 is selected to be 700 W or below in consideration of rush current to flow at the time of power-up and the flicker of a fluorescent lamp to occur on the turn-on and turn-off of the heater.

The cleaning roller 31 is positioned in the vicinity of the coating roller 32, but upstream of the coating roller 32 in the direction F of movement of the belt 2. The cleaning roller 31 and coating roller 32 both are held in contact with the belt 2. Drive means, not shown, drives the cleaning roller 31 and coating roller 32 in directions H and G, respectively, such that their surfaces move in the same direction and at the same speed as the belt 2. The cleaning roller 31 scrapes off toner transferred from the sheet S to the belt 2 to thereby refresh the surface of the belt 2. The coating roller 32 coats the parting agent fed from the agent feeding means 50 on the belt 2 by an adequate amount; the major component of the parting agent is silicone oil. A moving mechanism not shown, selectively moves the agent feeding means 50 into or out of contact with the coating roller 32.

The coating roller 32 is made up of a metallic shaft or core and silicone rubber foam covering the shaft. The coating roller 32 coats the parting agent fed from the agent feeding means 50 on the belt 2, insuring the adequate separation of the sheet S from the belt 2. The transmittance and haze of an OHP sheet are dependent on the cell diameter of silicone rubber foam, as stated earlier. The agent feeding means 50 is controlled by the moving mechanism in such a manner as to feed a preselected amount of parting agent to the belt 2 via the coating roller 32. However, the agent feeding means 50 feeds oil to the coating roller 32 via a piece of felt, so that the amount of oil coated on the belt 2 varies over a range of 2 mg/A4 and 15 mg/A4.

Figure 3:
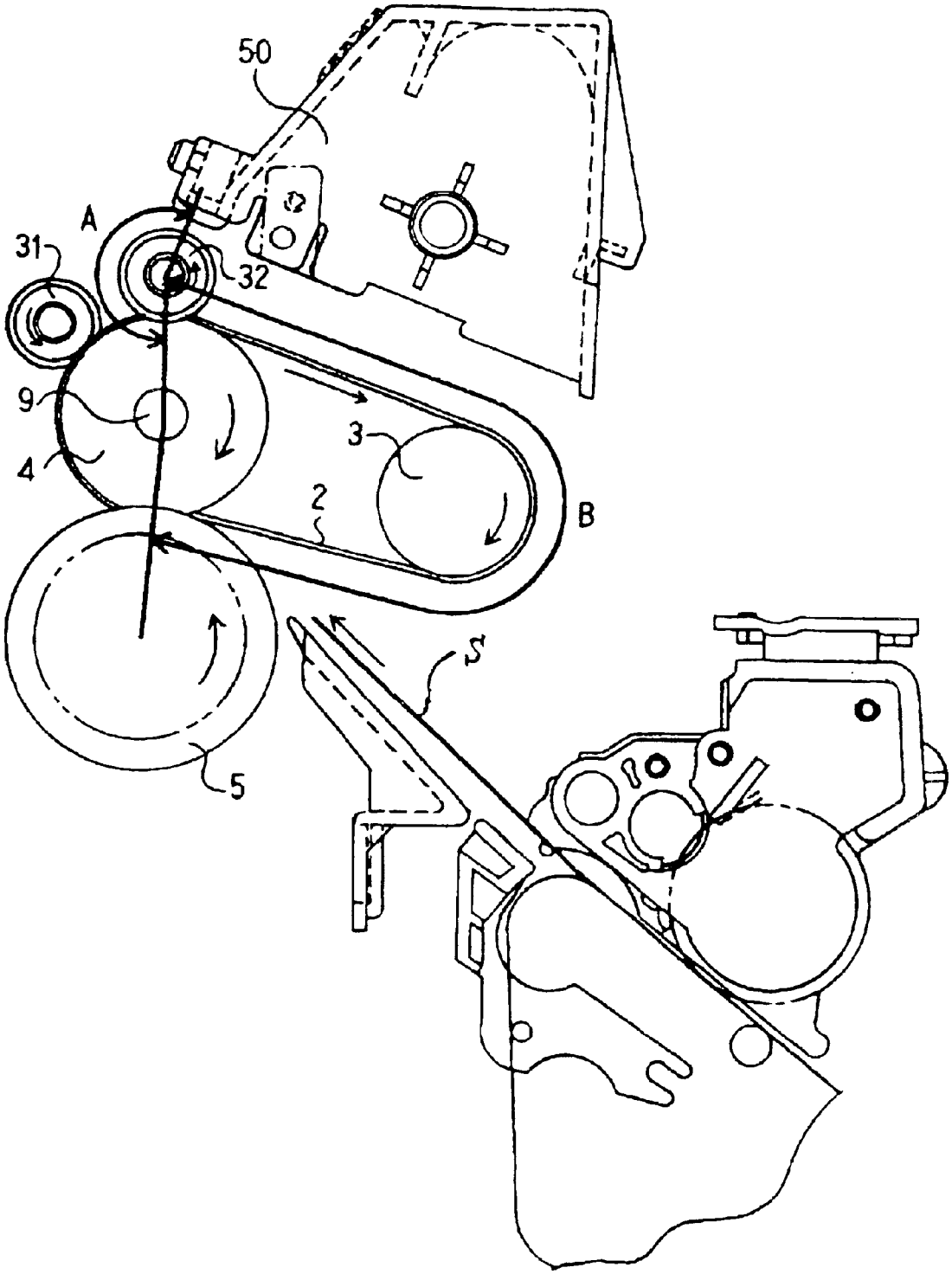
FIG. 3 is a view for describing a relation between a period of time T, distances A, B and C and linear velocity of image formation unique to the illustrative embodiment.

Reference will be made to FIG. 3 for describing a relation between a period of time up to the arrival of the sheet S at the nip between the belt 2 and the press roller 5, distances, and linear velocity for image formation. As shown, assume that a distance from the center of a nip between the agent feeding means 50 and the coating roller 32 to the center of the nip between coating roller 32 and the belt 2 is A. In the illustrative embodiment, the coating roller 32 is rotatable counterclockwise, as viewed in FIG. 3, so that the above distance A is measured at the left-hand side of the roller 32. Also, assume that a distance from the center of the nip between the coating roller 32 and the belt 2 to the center of the nip between the belt 2 and the press roller 5 is B. In the illustrative embodiment, the belt 2 is movable clockwise, as viewed in FIG. 3, so that the above distance B is measured at the right-hand side of the belt 2. Further, assume that the circumferential length of the belt 2 is C, although not shown specifically.

In the illustrative embodiment, linear velocity of image formation is 60 mm/sec while the coating roller 32 has a diameter of 14 mm, a circumferential length of 44 mm, and an angle of 200° for the distance A. Therefore, the distance A is 24 mm. Further, the belt 2 has a diameter of 60 mm and a circumferential length of 188.5 mm while the roller 4 has a diameter of 30 mm and a circumferential length of 94.2 mm. Further, the angle of the belt 2 not lying in the distance B is 172°=45 mm. Therefore, the distance B is 143.5 mm produced by subtracting 45 mm from the circumferential length of the belt 2, which is 188.5 mm and labeled C hereinafter.

The agent feeding means 50 is selectively moved into or out of contact with the coating roller 32 in synchronism with the image formation and sheet feed of the apparatus shown in FIG. 1. Toner images transferred to the sheet S at the Y, M, C and BK image stations one above the other are fixed by the fixing device 1 and then driven out as an image. Image forming timing is generally determined with priority given to productivity. In light of this, the illustrative embodiment also forms an image at such timing that the sheet S arrives at the nip between the belt 2 and the press roller 5 when the belt 2 fully moves a distance of A+B, i.e., 24+143.5=167.5 mm (=2.79 sec) after the agent feeding means 50 has started contacting the coating roller 32. If the sheet S arrives at the nip between the belt 2 and the press roller 5 before the above timing; then a sheet jam is apt to occur due to defective separation of the sheet S from the belt 2 ascribable to short parting agent.

Figure 4:
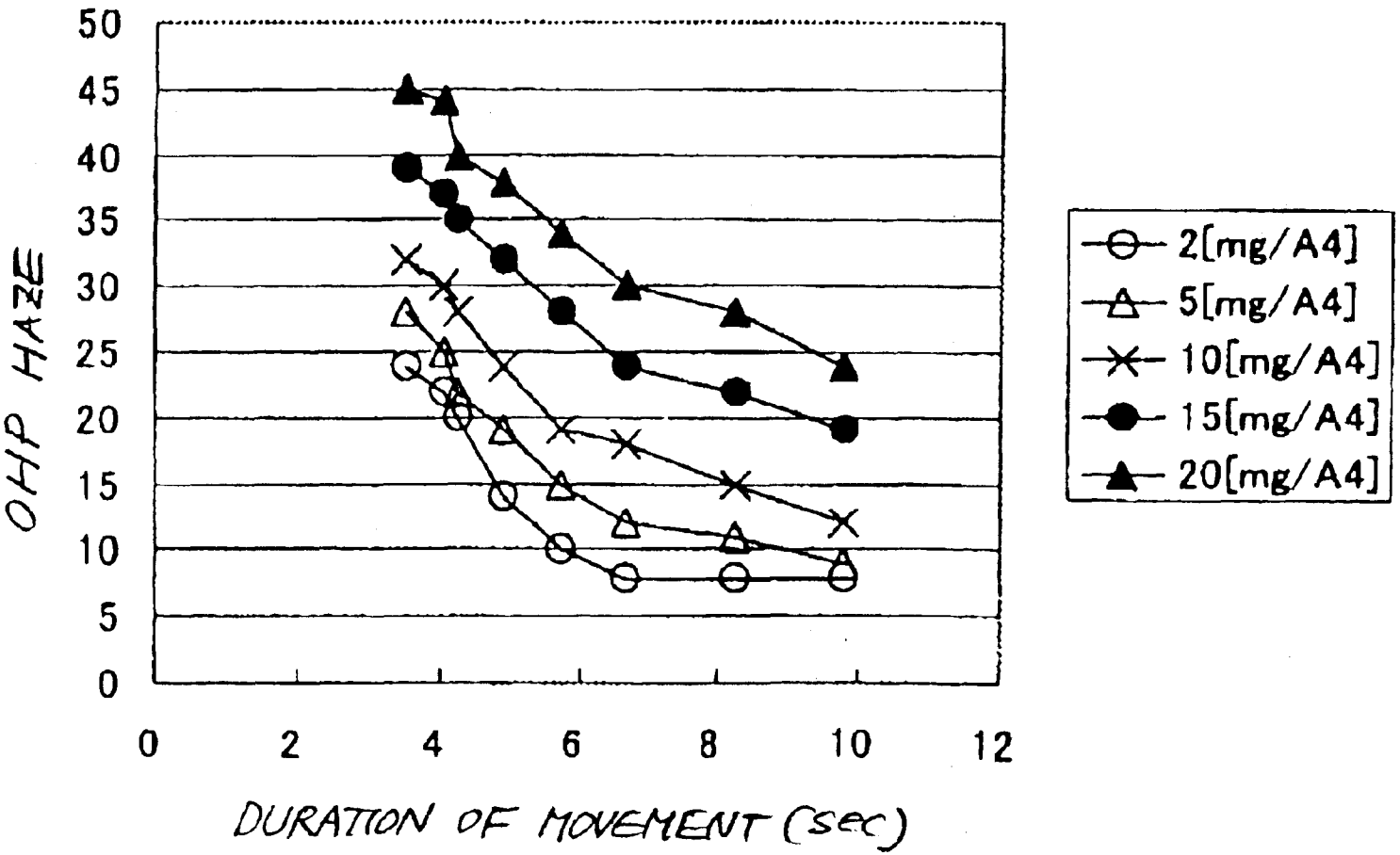
FIG. 4 is a graph showing a relation between the prerotation time of a fixing belt included in the illustrative embodiment and the haze of an OHP sheet with respect to the amount of oil initially coated.

FIG. 4 is a graph showing a relation between the duration of movement of the belt 2 after the release of the agent feeding means 50 from the coating roller 32 and the degree of haze of an OHP sheet with respect to the amount of the parting agent or oil initially coated on the belt 2. In the illustrative embodiment, the duration of contact of the agent feeding means 50 and coating roller 32 is selected to correspond to one full rotation of the roller 32, so that the parting agent can be uniformly impregnated in the roller 32. For this reason, a period of time indicated by the abscissa of FIG. 4 is representative of the sum of the distance A+B and one rotation of the coating roller 32 whose diameter is 14 mm, i.e., 44 mm. In FIG. 4, a period of time of 3.53 second or less does not allow the sheet S to be passed because it is apt to result in short parting agent, as stated previously.

Haze was measured with OHP sheets PP2260 available from 3M as to a yellow portion having a mesh area ratio of 80%. For the measurement, use was made of a turbidimeter 300A available from NIPPON DENSHOKU. The amount of oil coated for a single sheet of sheet of size A4 is between 2 mg/A4 and 15 mg/A4. Taking account of the worst irregularity value ascribable to the agent feeding means 50, the relationship between the duration of movement of the belt 20 and the degree of OHP haze was measured within the range of 2 mg/A4 and 20 mg/A4. As shown in FIG. 4, when the amount of parting agent initially coated was 10 mg/A4 or below, the standardized degree of haze of 30 or below was satisfied if the entry of a sheet was delayed by 4 seconds from the start of movement of the belt 2 and by about 0.5 second from the usual image forming timing. However, the entry of a sheet had to be delayed by about 5.7 seconds when the amount of parting agent was 15 mg/A4, which is the upper limit, or by about 6.7 seconds if it was 20 mg/A4. Such a delay is equal to the value stated with reference to FIG. 3:

(one turn of roller 32+A+B+C)/linear velocity of image formation

Experimental results relating to the deposition of the parting agent on the belt 2 will be described hereinafter. First, just after the start of movement of the belt 2, the parting agent was selectively deposited on the belt 2 over an area corresponding to the cell diameter of the coating roller 32. Particularly, when the amount of parting agent initially coated was large, the distribution of the parting agent on the belt 2 was locally so irregular, the transmittance of an OHP sheet was noticeably lowered while color haze was conspicuous.

The parting agent conveyed by the belt 2 via the nip between the belt 2 and the press roller 5 was uniformly leveled while, at the same time, the parting agent was partly transferred to the press roller 5 and collected thereby. As a result, the absolute amount of parting agent on the belt 2 was reduced. Even when the parting agent was again coated on the belt 2 by the coating roller 32 in the irregular distribution, the parting layer already deposited on the belt 2 in the form of a thin, uniform layer obviates the conspicuous, local irregularity stated earlier if the movement of the belt 2 was continuous Consequently, an OHP sheet was free from a noticeable decrease in transmittance and conspicuous haze. More specifically, haze did not exceed the standardized OHP haze degree even when the amount of coating agent was relatively large.

As stated above, in the illustrative embodiment, fixation is effected within a range in which oil fed from the agent feeding means 50 to the coating roller 32 has moved away from the nip between the belt 2 and the press roller 5 at least one time. In this condition, despite that the agent feeding means 50 is of the type using a piece of felt impregnated with oil and easy for the user to replace, there can be obviated irregular coating ascribable to the cell diameter of the sponge rubber of the coating roller 32 and a decrease in the transmittance of an OHP sheet as well as haze ascribable irregular coating. Further, the illustrative embodiment realizes rapid warm-up of the fixing device.

The shortest period of time in which the fixing device 1 reaches the adequate fixing condition after the contact of the agent feeding means 50 with the coating roller 32 is, as stated earlier, produced by:

(A+B)/linear velocity of image formation.

More specifically, the above period of time is:

(24+143.5)/60=2.79(sec)

By contrast, the illustrative embodiment needs, up to the start of image formation, a period of time expressed as:

(one turn of roller 32+A+B+C)/linear velocity of image formation

More specifically, the above period of time is:

(44+24+143.5+188.5)/60=6.67 (sec)

Consequently, the illustrative embodiment needs an extra period of time of (one turn of roller 32+C)/linear velocity, i.e., 3.88 seconds up to the end of image formation, lowering productivity. This is particularly true when a plurality of sheets of continuously passed due to intervals between the sheets.

Because the illustrative embodiment addresses mainly to a decrease in the transmittance of an OHP sheet and color haze, it is not necessary to apply the illustrative embodiment to plain paper sheets or thick sheets at the cost of productivity. In addition, some users may give priority to productivity even for OHP sheets. It is therefore preferable to allow the user to select desired conditions on, e.g., the operation panel of the image forming apparatus for thereby selecting either one of productivity and image quality.

While the heating member of the illustrative embodiment is implemented by the heat roller 3, roller 4 and belt 2, any other suitable heating member, e.g., a heater roller type of heating member, a film heating type of heating member or an electromagnetic induction type of heating member may be used. Also, the coating roller 32 may be replaced with any other coating member so long as it comprises a rotary body formed of foam.

In summary, in accordance with the present invention, fixation is effected within a range in which a parting agent fed from agent feeding means to a coating member has moved away from a nip between a heating member and a pressing member at least one time. In this condition, despite that the agent feeding means is of the type using a piece of felt impregnated with oil and easy for the user to replace, there can be obviated irregular coating ascribable to the cell diameter of the sponge rubber of the coating member and a decrease in the transmittance of an OHP sheet as well as haze ascribable irregular coating. Further, the present invention realizes rapid warm-up of a fixing device of the type using a belt.

Various modifications will become possible for those skilled in the art after receiving the teachings of the present disclosure without departing from the scope thereof.

What is claimed is:

1. A fixing device for fixing a toner image carried on a recording medium on said recording medium, said fixing device comprising:

a heating member;

a pressing member facing said heating member;

a coating member configured to coat a parting agent on said heating member; and agent feeding means intermittently brought into contact with said coating member for feeding the parting agent;

wherein assuming that a distance between a nip between said agent feeding means and said coating member, as measured in a direction of forward rotation of said coating member, is A, that a distance between a nip between said coating member and said heating member and a nip between said heating member and said pressing member, as measured in a direction of forward rotation of said heating member, is B, and that a circumferential length of said heating member is C, then a period of time T in which the recording medium enters said nip between said heating member and said pressing member satisfies a relation:

$A+B+C$/linear velocity of image formation $\leqq T$.

2. The fixing device as claimed in claim 1, wherein said heating member comprises:

a heat roller accommodating a heat source;

a roller spaced from said heat roller by a preselected distance; and a fixing belt passed over said heat roller and said roller;

wherein said fixing roller is held in contact with said pressing member to be driven in an interlocked relation.

3. The fixing device as claimed in claim 1, wherein said agent feeding means comprises a piece of felt impregnated with oil.

4. The fixing device as claimed in claim 3, wherein said heating member comprises:

a heat roller accommodating a heat source;

a roller spaced from said heat roller by a preselected distance; and a fixing belt passed over said heat roller and said roller;

wherein said fixing roller is held in contact with said pressing member to be driven in an interlocked relation.

5. In an image forming apparatus comprising a fixing device configured to fix a toner image carried on a recording medium on said recording medium, said fixing device comprising:

a heating member;

a pressing member facing said heating member;

a coating member configured to coat a parting agent on said heating member; and agent feeding means intermittently brought into contact with said coating member for feeding the parting agent;

wherein assuming that a distance between a nip between said agent feeding means and said coating member, as measured in a direction of forward rotation of said coating member, is A, that a distance between a nip between said coating member and said heating member and a nip between said heating member and said pressing member, as measured in a direction of forward rotation of said heating member, is B, and that a circumferential length of said heating member is C, then a period of time T in which the recording medium enters said nip between said heating member and said pressing member satisfies a relation:

$$A+B+C/\text{linear velocity of image formation} \leqq T.$$

6. The apparatus as claimed in claim 5, wherein said heating member comprises:

a heat roller accommodating a heat source;

a roller spaced from said heat roller by a preselected distance; and a fixing belt passed over said heat roller and said roller;

wherein said fixing roller is held in contact with said pressing member to be driven in an interlocked relation.

7. The apparatus as claimed in claim 5, wherein said agent feeding means comprises a piece of felt impregnated with oil.

8. The apparatus as claimed in claim 7, wherein said heating member comprises:

a heat roller accommodating a heat source;

a roller spaced from said heat roller by a preselected distance; and a fixing belt passed over said heat roller and said roller;

wherein said fixing roller is held in contact with said pressing member to be driven in an interlocked relation.

* * * * *